US008077903B2

(12) United States Patent
McKenzie

(10) Patent No.: US 8,077,903 B2
(45) Date of Patent: Dec. 13, 2011

(54) METHOD AND APPARATUS FOR CONTROLLING MATERIAL VIBRATION MODES IN POLYMER AND PAPER HIGH PERFORMANCE SPEAKER DIAPHRAGMS

(76) Inventor: Mark Douglas McKenzie, Reynoldsburg, OH (US)

( * ) Notice: Subject to any disclaimer, the term of this patent is extended or adjusted under 35 U.S.C. 154(b) by 1316 days.

(21) Appl. No.: 11/582,682

(22) Filed: Oct. 18, 2006

(65) Prior Publication Data

US 2007/0092101 A1 Apr. 26, 2007

Related U.S. Application Data

(60) Provisional application No. 60/729,982, filed on Oct. 25, 2005.

(51) Int. Cl.
*H04R 11/02* (2006.01)

(52) U.S. Cl. ..... 381/426; 381/423

(58) Field of Classification Search ..... 381/423, 381/426, 429; 181/157, 167, 168, 169, 173, 181/174

See application file for complete search history.

(56) References Cited

U.S. PATENT DOCUMENTS 1,080,953 A 12/1913 Cutucci
1,870,417 A * 8/1932 Mallina ..... 181/173
1,990,409 A 2/1935 Lawrance
2,531,634 A 11/1950 Lawrance
3,093,207 A 6/1963 Bozak
3,983,337 A 9/1976 Babb
4,581,496 A 4/1986 Sweany
5,304,746 A * 4/1994 Purvine ..... 181/157
5,521,886 A * 5/1996 Hirosawa et al. ..... 381/398
6,026,929 A 2/2000 Farone
6,611,604 B1 8/2003 Irby et al.
6,863,153 B1 3/2005 Hayakawa
2005/0078850 A1 4/2005 Norton

OTHER PUBLICATIONS

Mark McKenzie, "Remaking Tang Band's W3-881S," AudioXpress, Dec. 2004, pp. 54-62, 35-12, Audio Amateur Corp, Peterborough.

* cited by examiner

*Primary Examiner* — Brian Ensey

(57) ABSTRACT

A method for reducing the radiation amplitude of material vibration modes (division vibrations) from a loudspeaker transducer diaphragm mechanically vibrated for the purpose of transforming an electrical signal into an acoustic signal. The diaphragm material may consist of formed paper or plastic sheet materials or molded paper pulp. The amplitude reduction of material vibration modes and pressure waves within the diaphragm material is accomplished by impressing small, shaped structures within the diaphragm material at critical locations determined by measurement with laser vibration analysis or position sensitive transient analysis of a loudspeaker transducer. The method is applied to the diaphragm material after it has been formed into the shape of a loudspeaker transducer diaphragm, either before or after the diaphragm has been assembled into a loudspeaker transducer.

6 Claims, 11 Drawing Sheets

Figure 3 amended
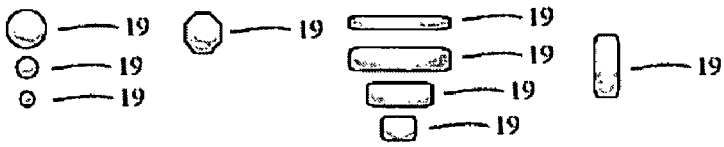

METHOD AND APPARATUS FOR CONTROLLING MATERIAL VIBRATION MODES IN POLYMER AND PAPER HIGH PERFORMANCE SPEAKER DIAPHRAGMS

CROSS-REFERENCE TO RELATED APPLICATIONS

This application claims the benefit of U.S. Provisional Application No. 60/729,982, filed Oct. 25, 2005, entitled "Method and Apparatus for Controlling Material Vibration Modes in Polymer High Performance Speaker Diaphragms;" U.S. patent application Ser. No. 11/477,027, filed Jun. 27, 2006, entitled "Boundary Layer Regulator for Extended Range Acoustical Transducers."

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The sound quality of loudspeaker transducers have been limited by unintended diaphragm material vibration modes also know as diaphragm breakup, diaphragm resonances, diaphragm ringing, modal behavior patterns, or divisional vibrations. Diaphragm material vibration modes are chaotic phenomena where diaphragm motions become highly complex and while they may develop as a consequence of the electromechanical excitation of the diaphragm 10 are generally unrelated to the aforementioned excitation. The cone vibration modes result in non-uniform velocity displacement of the diaphragm and deviation from the ideal of piston-like behavior of the diaphragm 10. The non-uniform velocity displacement causes peaks and valleys in the frequency response of the loudspeaker transducer resulting in non-linear acoustic output at varying frequencies.

The quantity, complexity, and magnitude of vibration modes exhibited by a given diaphragm 10 as part of an assembled loudspeaker transducer is highly dependent upon small variations in origin conditions that include variations in loudspeaker transducer elements including loudspeaker surrounds 11 and voice coil formers 12. Specific loudspeaker transducer diaphragm vibration modes are difficult to predict in the cone design stage and can be resistant to corrective measures that assume the diaphragm operating as one coherent mechanical element or a tightly coupled collection of coherent diaphragm regions.

Prior attempts at reducing or eliminating loudspeaker transducer diaphragm vibration modes have modeled the diaphragm either as one coherent element or as a simple assembly of several coherent sectors and attempted to correct the material vibration modes by either stiffening the diaphragm, making the diaphragm more rigid or linking or bridging coherent diaphragm regions together.

The first approach is exemplified by diaphragms with more complex cone or dome shape. This shaping may include features such as extended neck dip 21 shaping of the cone slope. A second approach is to use materials of greater inherent rigidity such as metal, fiberglass, carbon fiber, or Kevlar composite materials 20. A third approach is exemplified by diaphragms molded or stamped such that they include features like annular concentric corrugations, ribs 22 (straight, circular, or spiral), spokes, pleats, assemblies of arcuated segments, a plurality of randomly placed three-dimensional features, or diaphragms with varying thickness. Here too, the intent is to stiffen regions of the diaphragm or to stiffen the entire diaphragm.

The commonality amongst these prior art approaches is diaphragm design and manufacture without consideration of how the later attachment of a surround and a voice coil former to the diaphragm can create diaphragm material vibration modes. Loudspeaker transducers made with the aforementioned stiffening approaches can still suffer from poor acoustical quality of the radiated sound due to contamination by diaphragm material vibration modes as shown in FIGS. 6, 9, 11, and 13. While the deviations from linear response differ in detail in magnitude, center frequency, and complexity, they are alike in kind that the deviations are caused by diaphragm material vibration modes.

BRIEF SUMMARY OF THE INVENTION

The present invention relates to electrodynamic loudspeaker transducer diaphragms, and more particularly to a loudspeaker transducer diaphragm having a good quality of acoustic output uncontaminated by acoustic output additions from diaphragm material vibration modes.

More specifically, the invention is directed to improving the quality of acoustic output by physically deforming and therefore changing the mechanical impedance of specific regions of loudspeaker transducer diaphragms 10 made from semi-rigid sheet materials or pulp slurries molded or formed to a predefined shape and capable of holding that shape even when unsupported. The diaphragm material deformations of the invention may weaken, strengthen, or do both to the area of diaphragm deformed. The design for the deformation locations is based upon the results of measurements made after the diaphragm has been attached to a surround 11 and voice coil former 12 and assembled into a complete loudspeaker transducer. This deformation design can then be applied to additional diaphragm iterations in manufacturing after the diaphragm has been formed and either before or after the loudspeaker transducer diaphragms have been made into sub assemblies consisting of diaphragms 10 surrounds 11 and voice coil formers 12.

BRIEF DESCRIPTION OF THE SEVERAL VIEWS OF THE DRAWING

FIG. 3 shows a sampling of possible dimple shapes.

DETAILED DESCRIPTION OF THE PREFERRED EMBODIMENT OF THE INVENTION

Figure 4:
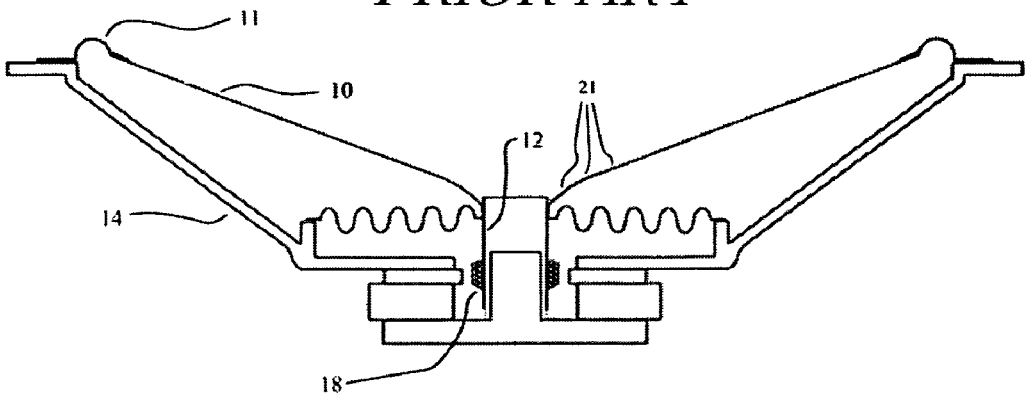
Figure 4 PRIOR ART
FIG. 4 is a cutaway of a paper cone diaphragm transducer with an extended neck dip feature.
Figure 7:
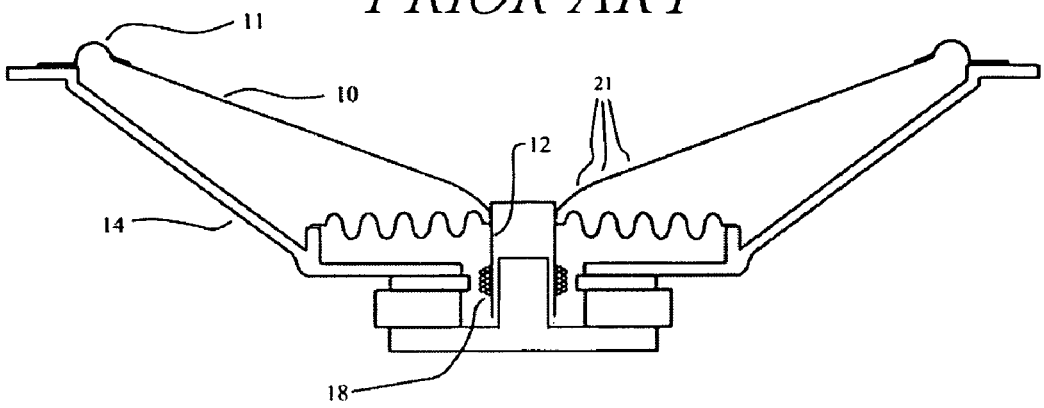
Figure 7 PRIOR ART
FIG. 7 is a cutaway side-view of a polypropylene cone diaphragm transducer with an extended neck dip feature.
Figure 8:
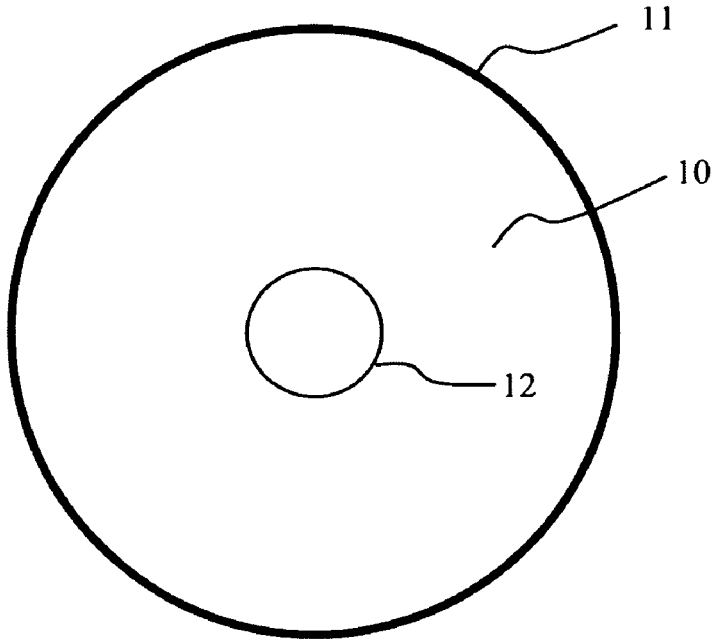
Figure 8 PRIOR ART
FIG. 8 is the top-view of the polypropylene cone diaphragm transducer of FIG. 7.

With continued reference to the drawing figures, particularly FIGS. 4, 7, 14, 16, and 18, an electrodynamic cone type diaphragm transducer utilized as a loudspeaker is shown in cutaway side and top views. The formed cone diaphragm is featureless except for the presence of a variation in the rate of cone slope by an extended neck dip 21 as shown in FIGS. 4 and 7. The diaphragm is assembled into a functional transducer further comprising a length of electrically conductive wire 18 wound around a voice coil former 12, having a top inside diameter and a top outside diameter and a bottom inside diameter and a bottom outside diameter, all of said diameters being disposed uniformly about a central axis; a transducer cone type diaphragm 10 of a semi-rigid membrane of self supporting shape having an inside diameter and an outside diameter disposed uniformly about a central axis, wherein the inside diameter of the transducer cone diaphragm is firmly attached to the top outside diameter of the voice coil former, and a surround 11, comprising a flexible suspension member having an inside diameter and an outside diameter disposed uniformly about the central axis, with the inside diameter being attached to the outside diameter of the transducer cone type diaphragm, and a transducer basket frame 14 uniformly disposed about the central axis and encircling the surround, further encircling the transducer cone type diaphragm, and further encircling the voice coil former, the transducer basket frame further attached to the outside diameter of the surround allowing for motion of the transducer cone type diaphragm and voice coil former relative to the stationary transducer basket frame.

Figure 9:
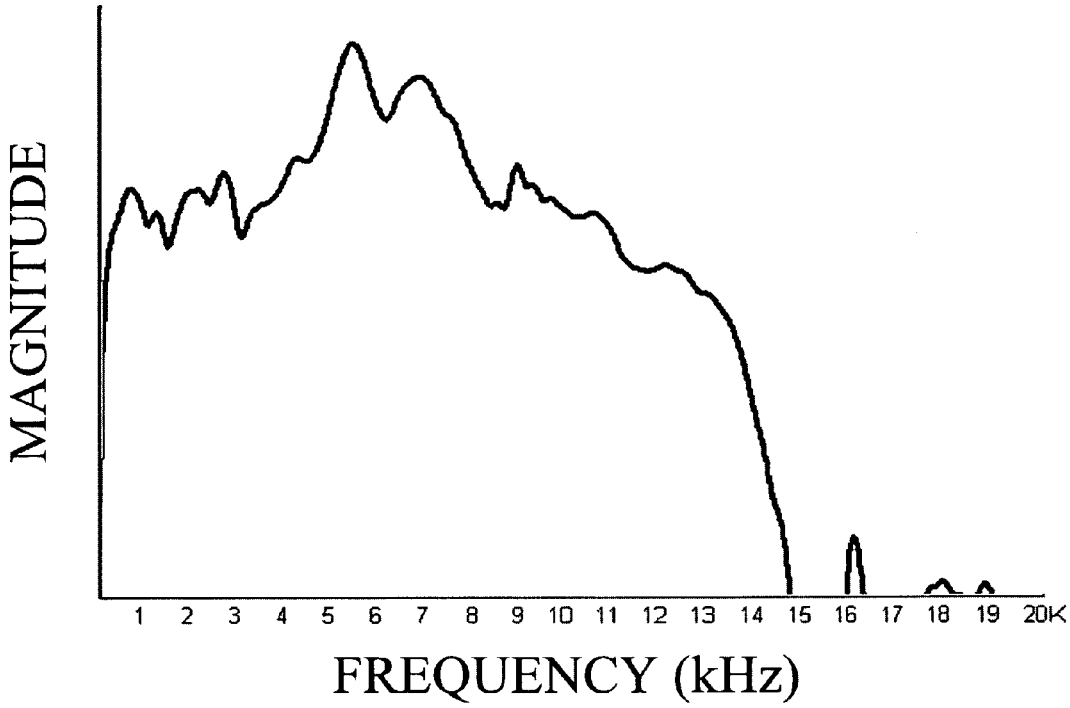
FIG. 9 shows the frequency response of the polypropylene cone diaphragm transducer of FIG. 7.
Figure 10:
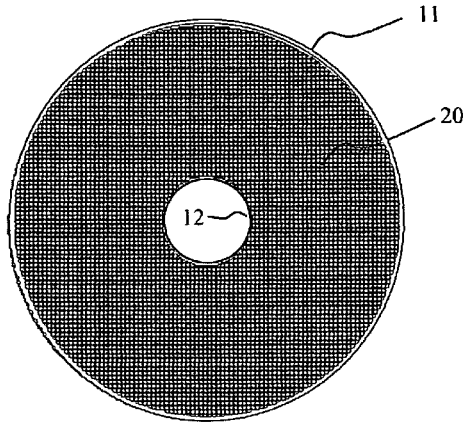
Figure 10 PRIOR ART
FIG. 10 is the top-view of a woven Kevlar composite cone diaphragm transducer.
Figure 11:
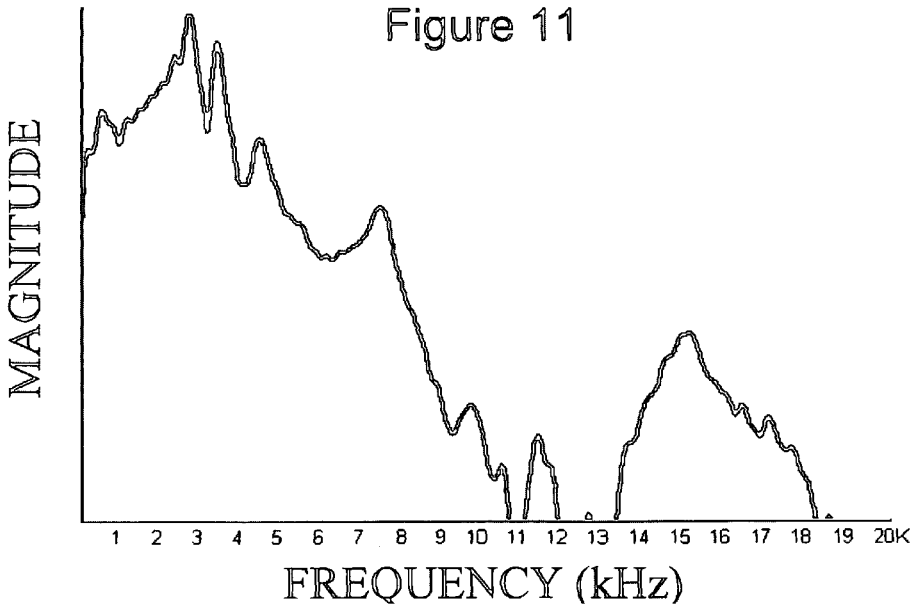
FIG. 11 shows the frequency response of the transducer of FIG. 10.

By far-field frequency response measurement (FIG. 9), it can be shown that the diaphragm of this loudspeaker transducer suffers from a complex set of material vibrations. There are four prominent diaphragm material vibration modes, with two modes of different center frequencies originating from the same annular region of the diaphragm. The annular vibration mode attractor or origin regions for this cone style transducer diaphragm may be determined through either laser vibration analysis or position sensitive transient analysis of an assembled transducer. The method described herein for diaphragm material vibration control is applied to the diaphragm material either before or after the diaphragm material is assembled into a loudspeaker transducer.

Figure 1:
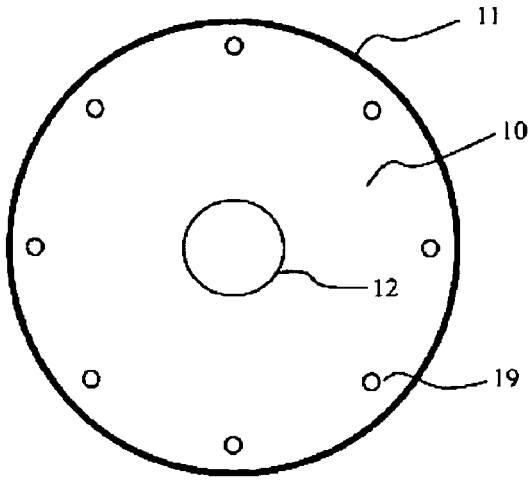
FIG. 1 is a top-view of a cone type loudspeaker transducer diaphragm showing one possible arrangement of the impressed round, spherical bottomed three-dimensional material deformations hereafter called dimples.
Figure 2:
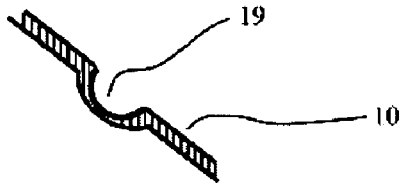
FIG. 2 is a cutaway side-view of one dimple shape showing the variation is bottom thickness characteristic of the process.

Diaphragm material vibration mode control may be accomplished by impressing a series of localized cone material deformations into the cone material precisely placed within the attractor or origin regions of the material vibration modes. A plurality of hollow bisected sphere dimples 19 having the cross-sectional shape of FIG. 2 are used (FIGS. 2 and 3).

In the preferred embodiment of the invention, the cone style diaphragm is made of polypropylene plastic material. The bisected hollow sphere shaped dimples are impressed into the polypropylene diaphragm material using a correspondingly shaped die. The die is heated to a temperature sufficient to soften the polypropylene material. The temperature of the die is kept below the flow region of polypropylene. The die temperature may be held in a range of 150 to 200 degrees Fahrenheit. The preferred die temperature is 170 degrees Fahrenheit.

The use of a heated die allows for ease in deforming the polypropylene diaphragm material while preserving the original semi-crystalline structure of the polypropylene material. The use of a die heated to approximately 170 degrees Fahrenheit eases the deformation of the material's three-dimensional shape while preserving the semi-crystalline structure and causes the maximum possible alteration of localized material mechanical impedance.

Figure 14:
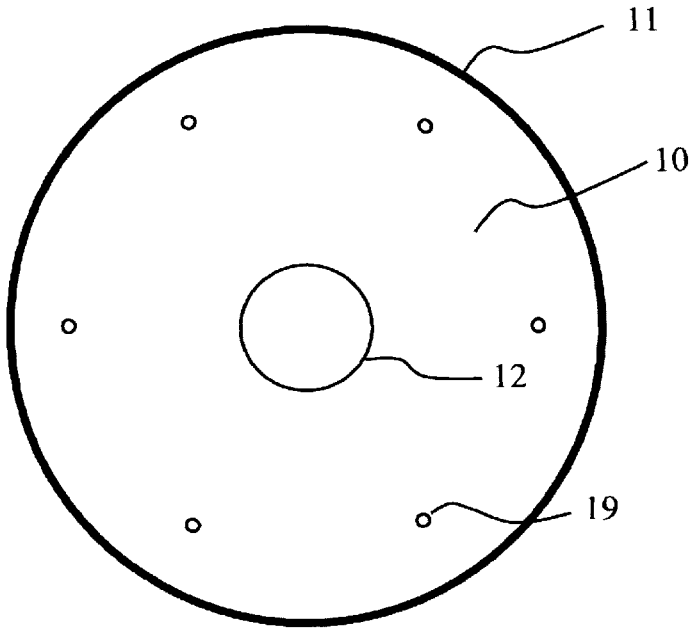
FIG. 14 is the top-view of the polypropylene cone diaphragm transducer of FIG. 7 with the addition of six round dimples impressed into the diaphragm surface.
Figure 15:
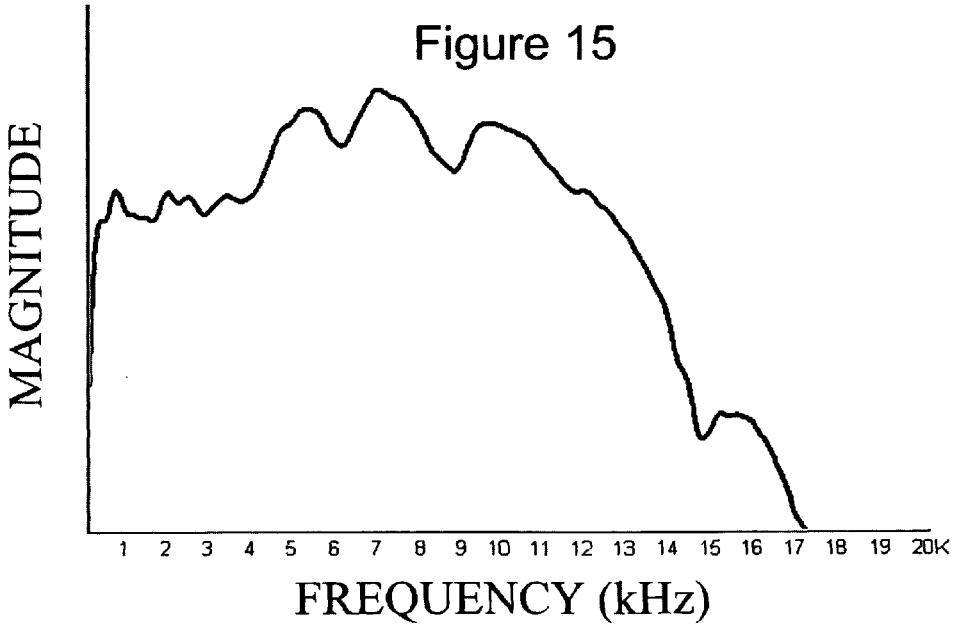
FIG. 15 shows the frequency response consequent to the addition of the six impressed dimples.

The six heated die diaphragm material deformations or dimples 19 shown in FIG. 14 controls the six kHz center frequency cone material vibration mode. Vibration modes with center frequencies of 5.7 kHz, 7.2 kHz, and 10 kHz remain.

Figure 16:
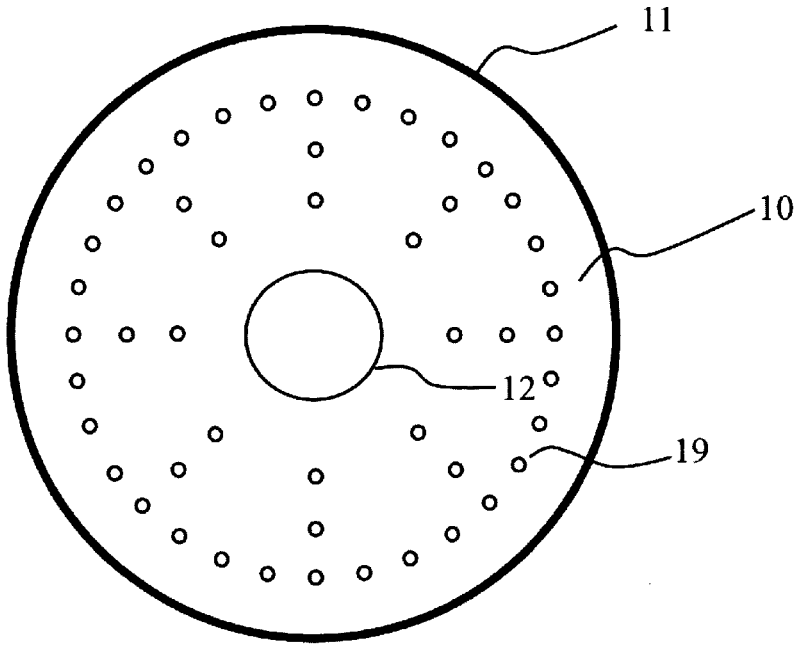
FIG. 16 is the top-view of the polypropylene cone diaphragm transducer of FIG. 7 with the six dimples of FIG. 14 plus additional 34 dimples.
Figure 17:
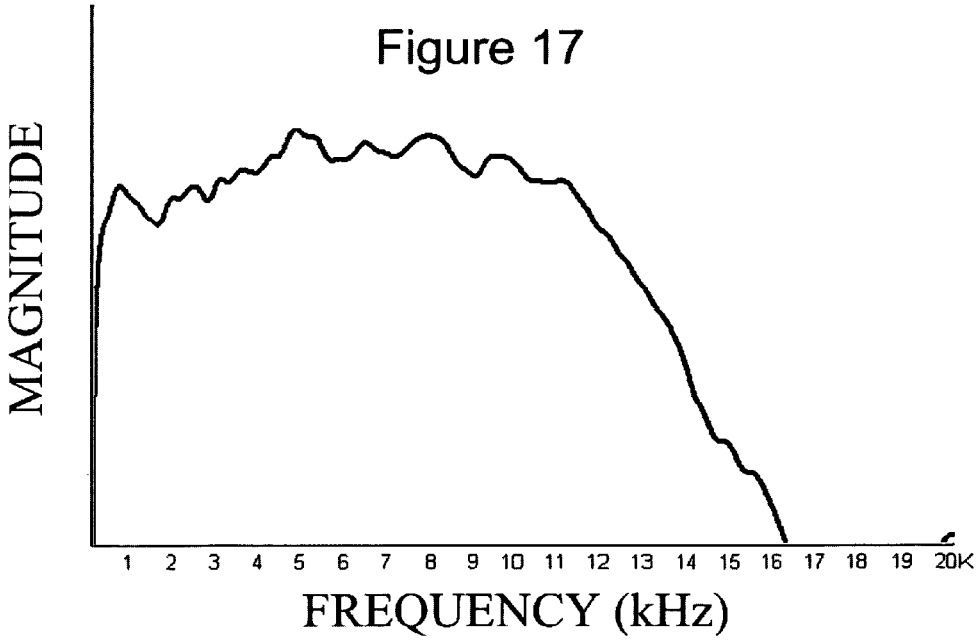
FIG. 17 shows the frequency response of the polypropylene cone diaphragm of FIG. 7 with 48 dimples.

The addition of 34 heated die dimples 19 shown in FIG. 16 control the remaining vibration modes at 5.7 kHz, 7.2 kHz, and 10 kHz as shown in FIG. 17. The 40 dimples 19 shown in FIG. 16 may be impressed into the polypropylene diaphragm material individually, as part of one forming operation, or any combination of the two. Manufacture of the vibration mode controlled cone is possible with a two step diaphragm stamping procedure. The first stamping comprises the cone style diaphragm shape. The second stamping comprises the addition of the precisely positioned three-dimensional shapes causing localized changes in diaphragm material mechanical impedance.

Figure 12:
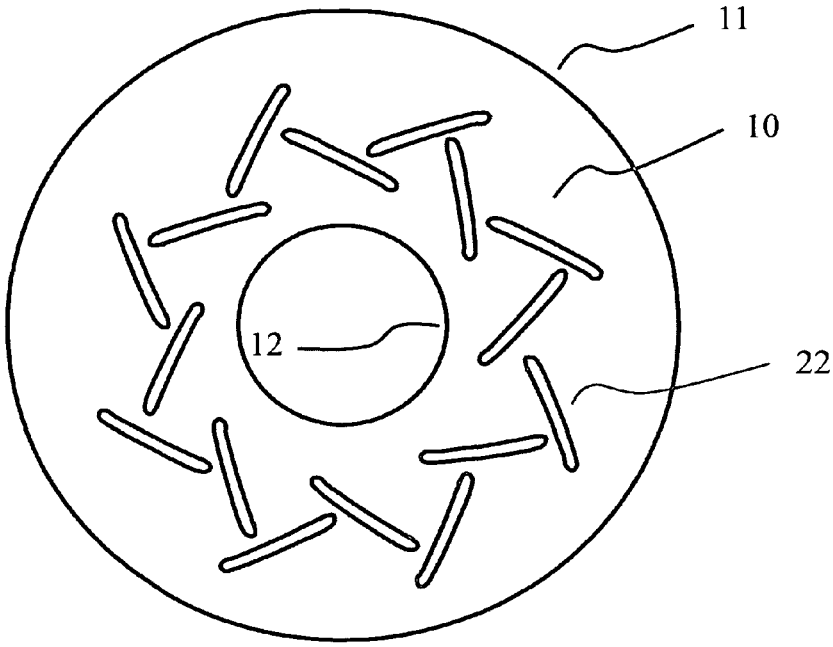
Figure 12 PRIOR ART
FIG. 12 is the top-view of a polypropylene cone diaphragm transducer with spiral ribs where the cone shape and the rib shapes were formed from sheet material as one process.
Figure 13:
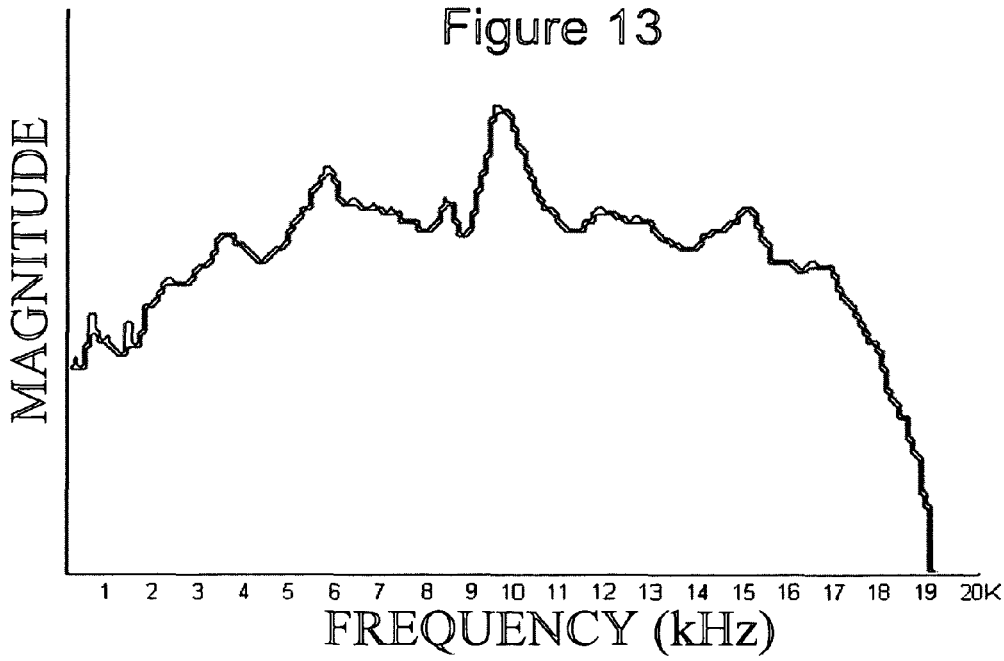
FIG. 13 shows the frequency response of the polypropylene cone diaphragm transducer of FIG. 12.
Figure 18:
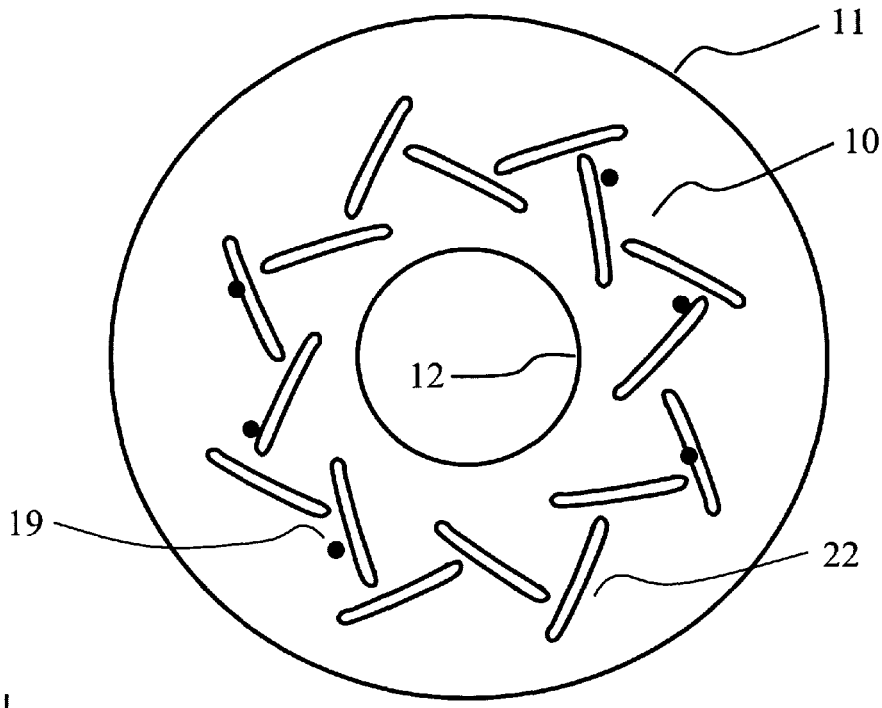
FIG. 18 is the top-view of the polypropylene cone diaphragm with spiral arcs of FIG. 12 with the addition of six impressed dimples.
Figure 19:
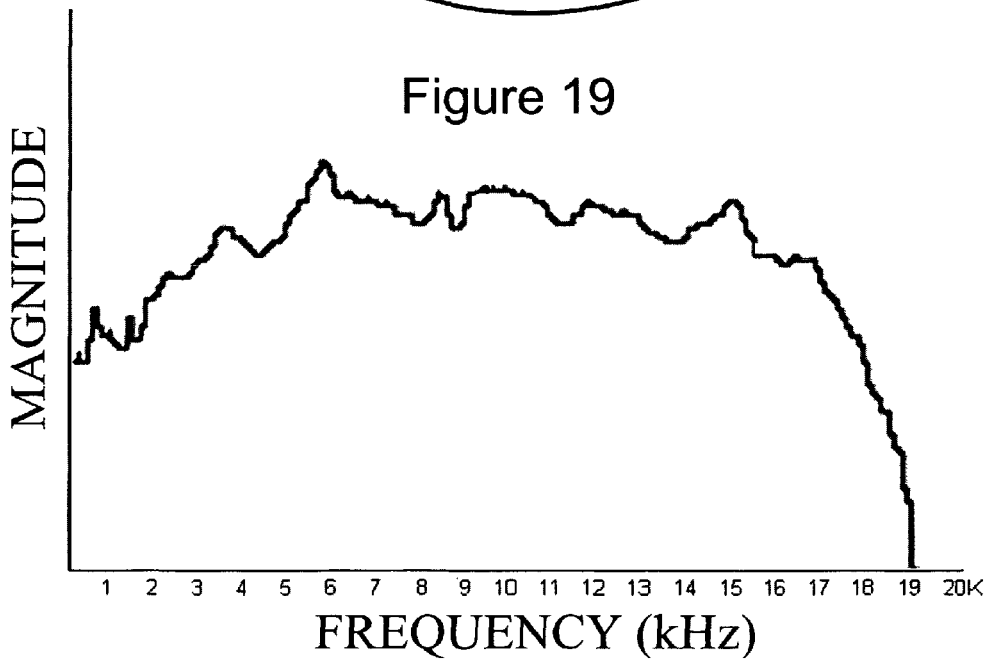
FIG. 19 shows the frequency response of the polypropylene cone diaphragm of FIG. 18.

A second example of the preferred embodiment is provided for the polypropylene diaphragm cone style transducer with crossed directional spiral ribs 22 of FIG. 12. This diaphragm also suffers from a complex number of material vibration modes. The vibration mode with a center frequency of 9.8 kHz (shown in FIG. 13) that has an annular attractor or origin region within the regions specified by the dimensions of the crossed directional spiral ribs. One possible placement of six bisected hollow spherical dimples 19 is shown in FIG. 18. The dimples of this second example are not evenly spaced. The spacing shown also sometimes intersects the crossed direction spiral arcs 22. This has no impact on the vibration mode control function of the six impressed dimples 19. The improvement in linearity of frequency dependent output is shown in FIG. 19.

Although the preferred embodiment makes uses of a plurality of bisected hollow spherical shaped dimples 19, there are pluralities of possible dimple shapes as shown in FIG. 3. Further, FIG. 3 shows only a limited selection of the possible dimple shapes. The bisected hollow spherical shaped dimple is used here only because of aesthetic considerations and ease of die manufacture. Using other dimple shapes of greater surface area can reduce the number of dimples required to achieve the same improvement in frequency dependent acoustic output linearity.

Second Embodiment

Figure 5:
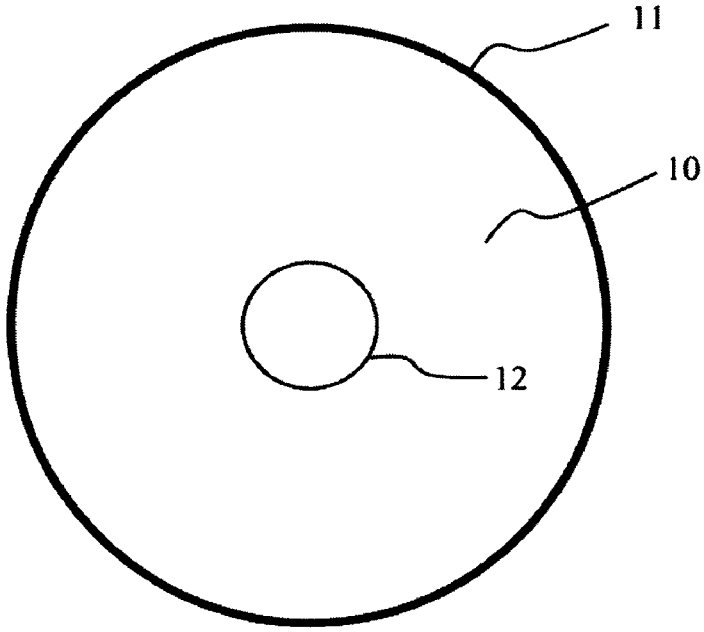
Figure 5 PRIOR ART
FIG. 5 is the top-view of the paper cone diaphragm of FIG. 4.
Figure 6:
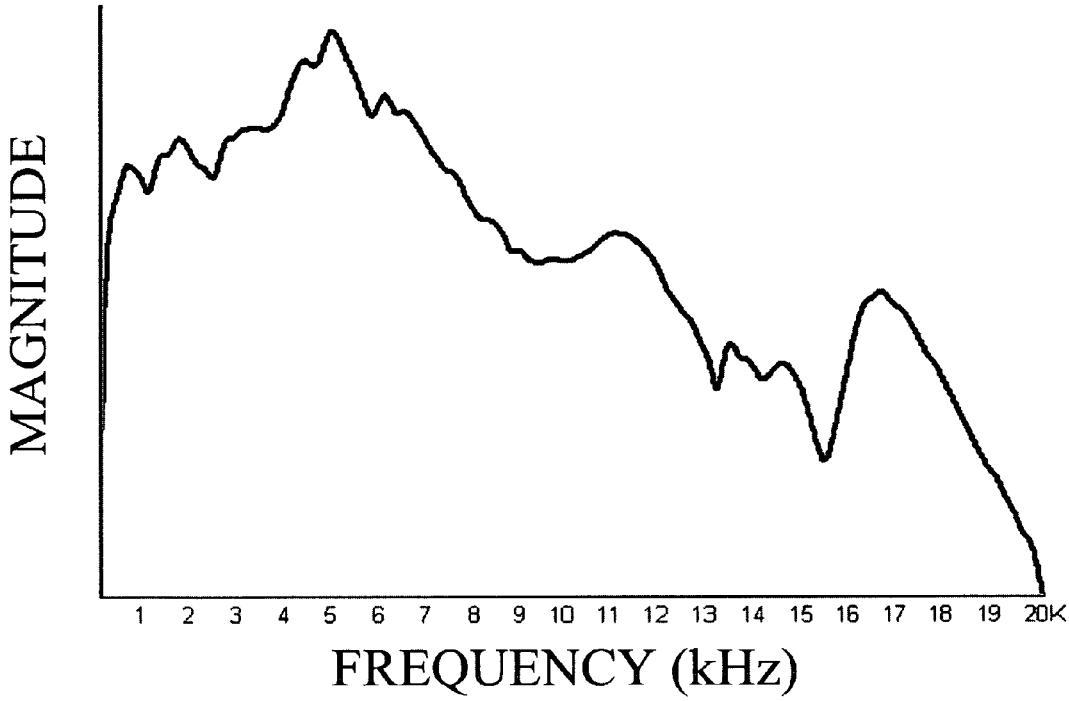
FIG. 6 shows the frequency response graph of the paper cone diaphragm transducer of FIG. 4.
Figure 20:
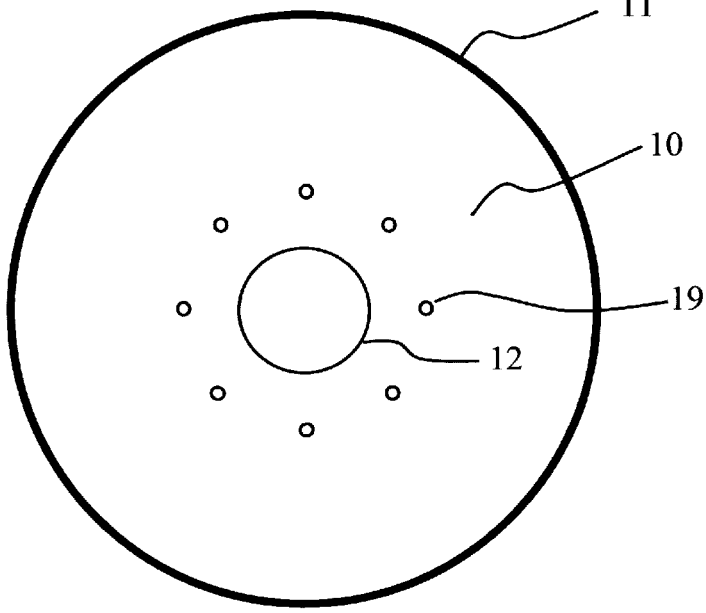
FIG. 20 is the top-view of the paper diaphragm of FIG. 4 with the addition of eight cold impressed round dimples.

A second embodiment of the invention is intended for transducer diaphragm 10 wherein the diaphragm material is formed paper sheet or pulp paper materials. Here the invention is applied to the paper diaphragm loudspeaker transducer of FIGS. 4 and 5. The frequency response of the loudspeaker transducer of FIG. 4 and 5 is shown in FIG. 6. The dimpling pattern to control the five kHz center frequency diaphragm material vibration mode is shown in FIG. 20. As in the preferred embodiment, the second embodiment utilizes the dimple shape of the preferred embodiment.

In the second embodiment, eight cold die dimples are impressed in the cone. The dimples have the cross-sectional shape shown in FIG. 2. In the second embodiment, the dimples alter the mechanical impedance of the dimpled area of the diaphragm material by displacing the location of paper fibers and disrupting adhesions amongst the paper fibers in the dimpled areas of the material.

Figure 21:
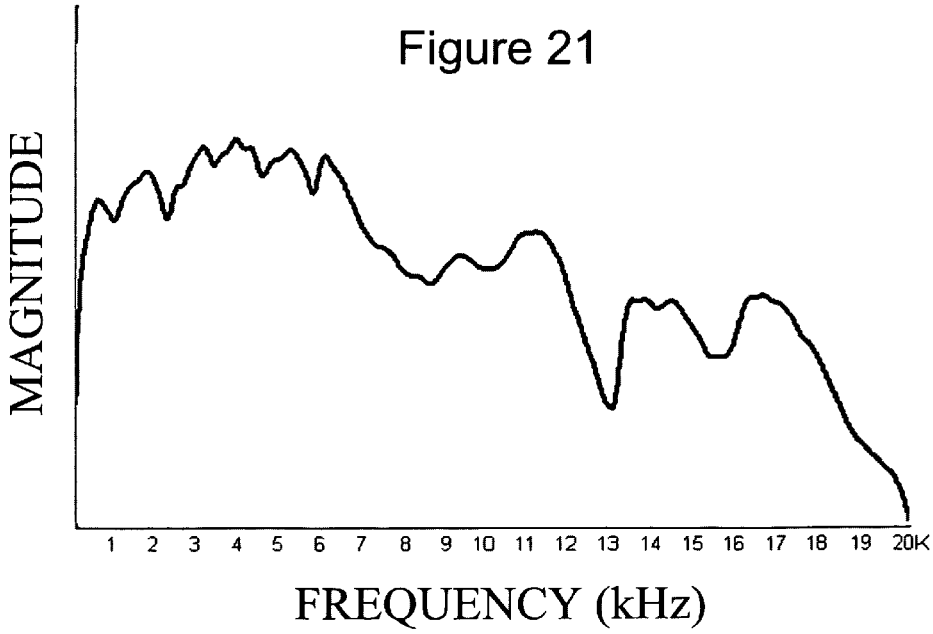
FIG. 21 shows the frequency response of the modified paper cone of FIG. 20.

The control provided by the eight dimples 19 shown in FIG. 20 causing the improvement in frequency dependent acoustic output shown in FIG. 21.

Although preferred embodiments of the invention have been described in detail, it is to be understood that various changes, substitutions and alterations can be made therein without departing from the spirit and scope of the invention as defined by the appended claims:

What is claimed:

1. A loudspeaker transducer for receiving an electrical signal and transmitting an acoustical signal through a transmission medium, wherein said acoustical signal is representative of said electrical signal, and wherein said transducer comprises:

a) a cone type direct radiating diaphragm further comprising a voice coil former having a top inside diameter and a top outside diameter and a bottom inside diameter and a bottom outside diameter, all of said diameters being disposed uniformly about a central axis;

b) a transducer cone type diaphragm of a semi-rigid polypropylene membrane of self supporting shape having an inside diameter and an outside diameter disposed uniformly about the central axis, wherein the inside diameter of the transducer cone diaphragm is firmly attached to the top outside diameter of the voice coil former, and c) a surround, comprising a flexible suspension member having an inside diameter and an outside diameter disposed uniformly about the central axis, with the inside diameter being attached to the outside diameter of the transducer cone type diaphragm, and d) a transducer basket frame uniformly disposed about the central axis and encircling the surround, further encircling the transducer cone type diaphragm, and further encircling the voice coil former, the transducer basket frame further attached to the outside diameter of the surround allowing for motion of the transducer cone type diaphragm and voice coil former relative to the stationary transducer basket frame, and a series of precisely defined and located areas of altered mechanical impedance relative to the mechanical impedance of adjacent areas of the semi-rigid self supporting membrane of the cone type diaphragm wherein the diaphragm material is polypropylene plastic and the localized areas of altered mechanical impedance are heated above ambient temperature but below polypropylene plastic's flow temperature.

2. The diaphragm of claim 1 wherein the alteration of the localized area of diaphragm material mechanical impedance comprises three-dimensional structures preserving the polypropylene material's semi crystalline structure.

3. The diaphragm of claim 1 wherein the diaphragm material is paper and the alteration of localized areas of diaphragm material mechanical impedance comprise stressing and tearing of the paper fiber.

4. The diaphragm of claim 3 wherein the diaphragm material is paper and the stressing and tearing of paper fiber does not perforate the diaphragm material.

5. The diaphragm of the transducer of claim 1 wherein the three dimensional structure formed after the diaphragm material has been formed into the shape of the electro-acoustic transducer diaphragm to produce a diaphragm or diaphragm section consisting of an uniform material wherein the uniform material has irregular or non uniform mechanical impedance is a single feature or multiple features that may be small or large in relation to the total area of the diaphragm when the diaphragm consists of one part or section of a diaphragm where the diaphragm is formed from more than one part.

6. A method of altering the mechanical impedance of the material comprising a diaphragm for use with an electro-acoustic transducer where the diaphragm is formed of one or more uniform materials where the mechanical impedance of one or more of the uniform materials is made non uniform using a shaped die or dies smaller in dimensions than the total surface area of the formed diaphragm, applied after the diaphragm has been formed into the shape of a diaphragm for use in a electro-acoustic transducer wherein the alteration of the localized area of diaphragm material mechanical impedance result in a diaphragm (or diaphragm section when the diaphragm is made of more than one uniform material) wherein the diaphragm (or section of diaphragm) has an irregular or non uniform mechanical impedance, and where the areas of irregular or non uniform mechanical impedance are comprised of three dimensional structures formed after the diaphragm material has been formed into the shape of the electro-acoustic transducer diaphragm.

* * * * *